US006749643B2

(12) United States Patent
Sugo et al.

(10) Patent No.: US 6,749,643 B2
(45) Date of Patent: Jun. 15, 2004

(54) METHOD OF DRY CLEANING AND DRY CLEANING SOLVENT THEREFOR

(75) Inventors: Michihiro Sugo, Gunma-ken (JP); Satoshi Asai, Gunma-ken (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 177 days.

(21) Appl. No.: 10/025,909

(22) Filed: Dec. 26, 2001

(65) Prior Publication Data

US 2002/0116769 A1 Aug. 29, 2002

(30) Foreign Application Priority Data

Dec. 26, 2000 (JP) ..... 2000-394481

(51) Int. Cl.[7] ..... D06L 1/02
(52) U.S. Cl. ..... 8/142; 510/466
(58) Field of Search ..... 8/142; 510/466

(56) References Cited

U.S. PATENT DOCUMENTS 4,685,930 A * 8/1987 Kasprzak
5,942,007 A * 8/1999 Bernd et al.
6,310,029 B1 * 10/2001 Kilgour et al.
6,312,476 B1 * 11/2001 Perry et al.
6,368,359 B1 * 4/2002 Perry et al.
6,596,892 B2 * 7/2003 Asai et al.

FOREIGN PATENT DOCUMENTS

EP 1 043 443 A1 10/2000

* cited by examiner

*Primary Examiner*—Margaret Einsmann
(74) *Attorney, Agent, or Firm*—Millen, White, Zelano, Branigan, P.C.

(57) ABSTRACT

The invention discloses a novel method for dry cleaning of a fabric material characterized by the use of a unique dry cleaning solvent which is a tris(trimethylsiloxy) silane compound represented by the general formula of $RSi(—O—SiMe_3)_3$, in which Me is a methyl group and R is a monovalent hydrocarbon group of 1 to 6 carbon atoms or, preferably, a methyl group, or a mixture thereof with a petroleum-based hydrocarbon solvent in a limited proportion. In addition to the excellent effect of dry cleaning equivalent to that of conventional dry cleaning solvents and little unpleasant smell remaining on the fabric material, the solvent used in the inventive method is little liable for the problems of environmental pollution against public and workers' health and the problem of ozone layer destruction in the aerosphere due to emission of vapors of halogenated hydrocarbon solvents can be solved by the inventive method.

12 Claims, No Drawings

METHOD OF DRY CLEANING AND DRY CLEANING SOLVENT THEREFOR

BACKGROUND OF THE INVENTION

The present invention relates to a novel method of dry cleaning of fabric materials and a dry cleaning solvent used therefor. More particularly, the invention relates to a dry cleaning method of fabric materials having advantages of, besides the high cleansing effect exhibited to an oily or greasy dirt deposited on the fabric material and pleasant touch feeling of the fabric material finiashed by the dry cleaning method, absence of unpleasant smell therefrom, little problems against environmental pollution possibly leading to destruction of the ozone layer in the aerosphere and safety against workers' health by virtue of the use of a unique dry cleaning solvent which has never been employed for this purpose of dry cleaning.

Needless to explain, dry cleaning is a process for cleaning a fabric material such as clothes in which the fabric material is immersed in or soaked with a non-aqueous organic solvent capable of dissolving oily or greasy dirt materials deposited on the fabric material so as to dissolve the dirt material out of the fabric material into the solvent followed by removal of the solvent from the cleaned fabric material and drying thereof.

A great variety of organic solvents have been proposed as the dry cleaning solvent and are actually employed for the purpose, of which the solvents currently under wide applications include halogenated hydrocarbon solvents, such as chlorofluorinated hydrocarbons and chlorinated hydrocarbons such as perchloroethylene, trichloroethylene and trichloroethane, and petroleum-based hydrocarbon solvents which are mainly paraffinic or naphthenic.

While advantageous in respects of non-inflammability and rapid drying, the above mentioned halogenated hydrocarbon solvents as a dry cleaning solvent have serious problems because vapors of such a halogenated hydrocarbon solvent emitted to the atmosphere are suspected to be liable for destruction of the ozone layer in the aerosphere in addition to the problem against public and workers' health due to contamination of the underground wate by discarded dry cleaning solvents and environmental pollution by the solvent vapor.

Accordingly, it is now a world-wide trend that use of halogenated hydrocarbon solvents is going to be banned not only as a dry cleaning solvent but also in any other applications. Petroleum-based hydrocarbon solvents are also noxious as an environmental pollutant against workers' health. For example, regulations in many countries prescribe the maximum permissible concentration of vapors of petroleum-based hydrocarbon solvents in the working environment at a very low level in order to ensure workers' health against toxication by the solvents. Among various proposals to solve this problem, Japanese Patent No. 1502875 proposes use of a cyclic organopolysiloxane oligomer or a mixture thereof with a petroleum-based hydrocarbon solvent as a dry cleaning solvent. Japanese Patent Kokai 6-327888 further discloses a method of dry cleaning by using a volatilizable organopolysiloxane having a straightly linear molecular structure as the dry cleaning solvent.

The above mentioned cyclic organopolysiloxane oligomer, however, has a disadvantage, when used as a dry cleaning solvent, that the cyclic organopolysiloxane oligomer is susceptible to ring-opening polymerization by the catalytic activity of the acidic or basic compound contained in the contaminant dirt material deposited on the fabric material for cleaning to produce a non-volatile organopolysiloxane of an increased degree of polymerization which in turn is deposited on the fabric material sometimes adversely affecting the touch feeling of the finished fabric material.

Japanese Patent Kokai 11-214587 teaches that organopolysiloxane oligomers are useful as a washing solvent of articles of a metal, ceramic, glass and plastic as well as semiconductor materials. It is unclear there, however, whether or not the organopolysiloxane oligomer be effective as a dry cleaning solvent for fabric materials or, in particular, clothes.

SUMMARY OF THE INVENTION

In view of the above described problems in the prior art method of dry cleaning, the present invention has an object to provide a novel method for dry cleaning of a fabric material by using a unique volatilizable organopolysiloxane compound as the dry cleaning solvent having advantages, in addition to the excellent cleansing effect on not only oily or greasy dirt materials but also some water-soluble dirt materials and very pleasant touch feeling of the fabric material finished by the method, that the dry cleaning solvent is not toxic against human body to ensure safety to the public and workers' health and that the solvent is not liable for the destruction of the ozone layer in the aerosphere due to emission of the vapor thereof to the atmosphere. The invention also has an object to provide a dry cleaning solvent used in the dry cleaning method.

Thus, the method of the present invention for dry cleaning of a fabric material comprises the steps of:

(a) immersing the fabric material in or soaking the fabric material with a dry cleaning solvent which is a tris (trimethylsiloxy) silane compound represented by the general formula $$RSi(—O—SiMe_3)_3, \quad (I)$$

In which Me is a methyl group and R is a monovalent hydrocarbon group having 1 to 6 carbon atoms, or a mixture thereof with a petroleum-based hydrocarbon solvent so as to dissolve dirt materials on the fabric material into the solvent;

(b) removing the dry cleaning solvent containing the dirt materials dissolved therein from the fabric material by solid-liquid separation; and (c) drying the fabric material wet with the dry cleaning solvent.

The invention also provides a dry cleaning solvent used in the above defined method of dry cleaning which comprises:, as a uniform mixture:

(A) at least 30% by weight of the tris(trimethylsiloxy) silane compound represented by the above given general formula (I); and (B) a petroleum-based hydrocarbon solvent in an amount not exceeding 70% by weight.

DETAILED DESCRIPTION OF THE PREFERRED EMBODIMENTS

As is described above, the dry cleaning method of the present invention is characterized by the use of, as the dry cleaning solvent, the tris(trimethylsiloxy) silane compound, referred to as the silicone solvent hereinafter, represented by the general formula (I) or a mixture thereof with a petroleum hydrocarbon solvent.

In the general formula (I) representing the silicone solvent, the group denoted by R is a monovalent hydrocarbon group having 1 to 6 carbon atoms exemplified by alkyl groups such as methyl, ethyl, propyl, butyl, pentyl and hexyl groups, cycloalkyl groups such as cyclopropyl, cyclobutyl, cyclopentyl and cyclohexyl groups and phenyl group, of which alkyl groups having 1 to 3 carbon atoms, i.e. methyl, ethyl and propyl groups, are preferable and methyl group is more preferable as R in respects of the low boiling point to ensure good volatilizability and inexpensiveness of methyl tris(trimethylsiloxy) silane.

Particular examples of the tris(trimethylsiloxy) silane compounds as the silicone solvent include: methyl, ethyl, propyl, butyl, pentyl and hexyl tris(trimethylsiloxy) silanes of the formulas $MeSi(—O—SiMe_3)_3$, $C_2H_5Si(—O—SiMe_3)_3$, $C_3H_7Si(—O—SiMe_3)_3$, $C_4H_9Si(—O—SiMe_3)_3$, $C_5H_{11}Si(—O—SiMe_3)_3$ and $C_6H_{13}Si(—O—SiMe_3)_3$, respectively, when R is an alkyl group, cyclopropyl, cyclobutyl, cyclopentyl and cyclohexyl tris(trimethylsiloxy) silanes expressed by the formulas $C_3H_5Si(—O—SiMe_3)_3$, $C_4H_7Si(—O—SiMe_3)_3$, $C_5H_9Si(—O—SiMe_3)_3$ and $C_6H_{11}Si(—O—SiMe_3)_3$, respectively, when R is a cycloalkyl group, and phenyl tris(trimethylsiloxy) silane of the formula $C_6H_5Si(—O—SiMe_3)_3$, when R is a phenyl group, in which Me is a methyl group. These silicone solvents can be used either singly or as a mixture of two kinds or more.

The above described tris(trimethylsiloxy) silane compound as the silicone solvent can be prepared by several different synthetic routes including, for example, the dehydrochlorination reaction between trimethyl silanol $Me_3SiOH$ and a trichlorosilane compound $RSiCl_3$, a co-hydrolysis/co-condensation reaction between a trichlorosilane compound $RSiCl_3$ and trimethyl chlorosilane $Me_3SiCl$ and a rearrangement reaction between hexamethyldisiloxane and a chlorosilane compound or an alkoxysilane compound.

The dry cleaning solvent used in the inventive dry cleaning method of fabric materials can be a mixture of the above described tris(trimethylsiloxy) silane compound and a petroleum-based hydrocarbon solvent which can be any of those used in the conventional dry cleaning processes and specified in JIS K2201-5 and ASTM D235. The petroleum-based hydrocarbon solvent can be paraffinic or naphthenic including benzines and solvent naphthas as well as isoparaffins. These petroleum-based hydrocarbon solvents can be used either singly or as a combination of two kinds or more.

The above described silicone solvent and the petroleum-based hydrocarbon solvent are freely miscible in any desired mixing proportions to give a uniform solvent mixture. When the dry cleaning solvent used in the inventive dry cleaning method is a mixture of the silicone solvent and the petroleum-based hydrocarbon solvent, it is preferable that the solvent mixture contains at least 30% by weight of the silicone solvent, the proportion of the hydrocarbon solvent not exceeding 70% by weight, in order to obtain the advantages to be accomplished by the inventive method. When the weight proportion of the silicone solvent in the solvent mixture is too small, the fabric material finished by dry cleaning by using the mixed solvent cannot be imparted with fully improved touch feeling in addition to the disadvantages inherent in the use of a petroleum-based hydrocarbon solvent.

The procedure of dry cleaning of fabric materials according to the invention is not particularly different from that in the conventional dry cleaning processes using a halogenated hydrocarbon solvent or a petroleum-based hydrocarbon solvent as the dry cleaning solvent excepting for the replacement of the conventional dry cleaning solvent with the silicone solvent or a mixture thereof with a petroleum-based hydrocarbon solvent so that the facilities for dry cleaning ready installed can be used as such in the inventive method. In step (a) of the inventive method, namely, the fabric material for cleaning is immersed in a sufficiently large volume of the dry cleaning solvent so as to dissolve out the dirt materials adhering to the fabric material into the solvent. Instead of immersion in the dry cleaning solvent, the fabric material can be soaked with a limited volume of the solvent, for example, by spraying the solvent. Application of ultrasonic waves to the fabric material or increase of the temperature up to 60° C. or in the range from 10 to 60° C. is sometimes effective to promote dissolution of the dirt materials in the solvent. In step (b) of the inventive method, the fabric material is separated from the solvent containing the dirt material dissolved therein in a solid-liquid separating method such as centrifugation and roller squeezing as completely as possible and, in step (c), the fabric material still wet with the solvent is dried by air drying, hot-air circulation drying or drying under reduced pressure.

In the following, the present invention is described in more detail by way of Examples, which, however, never limit the scope of the invention in any way. The Examples are preceded by the description of the synthetic preparation of the tris(trimethylsiloxy) silane compounds.

SYNTHESIS EXAMPLE 1

Methyl tris(trimethylsiloxy) silane was prepared in the following manner. Thus, 1296 g (8 moles) of hexamethyl disiloxane, 100 g of concentrated hydrochloric acid and 30 g of water were introduced into a four-necked flask of 2 liter capacity to form a reaction mixture which was chilled by immersing the flask in an ice water bath. Thereafter, 359 g (2.4 moles) of methyl trichlorosilane were added dropwise into the reaction mixture under agitation and chilling and agitation of the reaction mixture was continued for further 1 hour to complete the reaction between hexamethyl disiloxane and methyl trichlorosilane. The reaction mixture was then neutralized with a 10% by weight aqueous solution of sodium hydrogencarbonate followed by washing with water and distillation under reduced pressure to give a colorless, clear liquid product having physical properties including: boiling point of 86° C. under 20 Torr, viscosity of 1.4 $mm^2/s$ at 25° C., density of 0.848 $g/cm^3$ at 25° C., refractive index of 1.386 at 25° C. and surface tension of 16.6 mN/m at 25° C., from which the liquid product could be identified to be methyl tris(trimethylsiloxy) silane. The yield of the product was 65% of the theoretical value.

SYNTHESIS EXAMPLE 2

Propyl tris(trimethylsiloxy) silane was prepared in the following manner. Thus, 303 g (3 moles) of triethylamine and 300 g of toluene were introduced into a four-necked flask of 2 liter capacity to give a solution which was chilled by immersing the flask in an ice water bath. Thereafter, 177.5 g (1 mole) of propyl trichlorosilane and 297 g (3.3 moles) of trimethyl silanol were added separately but concurrently each dropwise into the solution in the flask under agitation followed by washing with water and distillation under reduced pressure to give a colorless, clear liquid product having physical properties including: boiling point of 78° C. under 12 Torr, viscosity of 2.2 $mm^2/s$ at 25° C., density of 0.852 $g/cm^3$ at 25° C., refractive index of 1.395 at 25° C. and surface tension of 17.1 mN/m at 25° C., from which the liquid product could be identified to be propyl tris(trimethylsiloxy) silane. The yield of the product was 55% of the theoretical value.

EXAMPLE 1

Three 15 cm by 15 cm square pieces of plain-woven cloths of polyester, nylon and cotton fibers were each smeared with 1 g of a motorcar oil on the respective center areas to serve as the oil-stained fabric specimens for the dry cleaning test. The thus stained test specimens were put together into 1 liter of methyl tris(trimethylsiloxy) silane prepared in Synthesis Example 1 held in the 3-liter washing vessel of a test washer machine and agitated therein for 15 minutes at 40° C. followed by roller squeezing and drying in a hot-air drying oven at 60° C. taking 60 minutes.

The conditions of each of the test specimens after the above described dry-cleaning run were examined by subjecting the specimens to organoleptic tests for the items of: (Evaluation Item I) cleansing effect on the oil-stained areas; (Evaluation Item II) touch feeling of the finished cloths; and (Evaluation Item III) smell due to remaining solvent. The results of each evaluation item were rated in two ratings of A (no trace of oil stain) and B (trace of oil stain recognizable) for the Evaluation Item I, in two ratings of A (good) and B (poor) for the Evaluation Item II and in three ratings of A (no smell), B (slight but noticeable smell) and C (noticeable smell) for the Evaluation Item III as shown in Table 1 below. Discoloration or denaturation was noted in none of the test specimens after the dry cleaning test.

EXAMPLE 2

The experimental procedure was substantially the same as in Example 1 described above excepting for the replacement of the methyl tris(trimethylsiloxy) silane as the dry cleaning solvent with the same volume of propyl tris(trimethylsiloxy) silane prepared in Synthesis Example 2. The results of the test cleaning are shown in Table 1. Discoloration or denaturation was noted in none of the test specimens after the dry cleaning test.

EXAMPLE 3

The experimental procedure was substantially the same as in Example 1 described above excepting for the replacement of the methyl tris(trimethylsiloxy) silane as the dry cleaning solvent with the same volume of a 50:50 by weight mixture of methyl tris(trimethylsiloxy) silane and a petroleum-based hydrocarbon solvent (Brightsol, a product by Shell Japan Co.). The results of the test cleaning are shown in Table 1. Discoloration or denaturation was noted in none of the test specimens after the dry cleaning test.

COMPARATIVE EXAMPLE 1

The experimental procedure was substantially the same as in Example 1 described above excepting for the replacement of the methyl tris(trimethylsiloxy) silane as the dry cleaning solvent with the same volume of the petroleum-based hydrocarbon solvent (Brightsol, supra) alone. The results of the test cleaning were clearly inferior for the Evaluation Items II and III as shown in Table 1 although no discoloration nor denaturation was noted in any of the test specimens after the dry cleaning test.

TABLE 1

| Fiber Evaluation | Polyester | | | Nylon | | | Cotton | | |
|---|---|---|---|---|---|---|---|---|---|
| Item | I | II | III | I | II | III | I | II | III |
| Example 1 | A | A | A | A | A | A | A | A | A |
| Example 2 | A | A | A | A | A | A | A | A | A |
| Example 3 | A | A | B | A | A | B | A | A | B |
| Comparative Example 1 | A | B | C | A | B | C | A | B | C |

What is claimed is:

1. A method of dry cleaning of a fabric material which comprises the steps of:

(a) immersing the fabric material in or soaking the fabric material with a dry cleaning solvents, which is a mixture consisting essentially of methyl tris (trimethylsiloxy) silane and a petroleum-based hydrocarbon solvent, so as to dissolve out dirt materials deposited on the fabric material into the solvent;

(b) removing the dry cleaning solvent containing the dirt material dissolved therein from the fabric material by solid-liquid separation; and (c) drying the fabric material wet with the dry cleaning solvent.

2. A method of dry cleaning of a fabric material as claimed in claim 1 in which the concentration of the petroleum-based hydrocarbon solvent in the mixture thereof with methyl tris(trimethylsiloxy) silane does not exceed 70% by weight.

3. A method of dry cleaning of a fabric material as claimed in claim 1 in which the step (a) is conducted at a temperature in the range from 10 to 60 ° C.

4. A dry cleaning solvent consisting essentially of mixture of at least 30% by weight of a methyl tris(trimethylsiloxy), and 70% by weight or less of a petroleum-based hydrocarbon solvent.

5. A method of dry cleaning of a fabric material as claimed in claim 1, wherein ultrasonic waves are applied to the material during step (a).

6. A method of dry cleaning of a fabric material as claimed in claim 1, wherein in step (b) the fabric material is separated from the solvent containing the dirt material dissolved therein by centrifugation and roller squeezing.

7. A method of dry cleaning of a fabric material as claimed in claim 1, wherein the fabric material is soaked by being sprayed with the dry cleaning solvent during step (a).

8. A method of dry cleaning of a fabric material as claimed in claim 1, wherein said solvent consists essentially of a mixture of at least 30% by weight of methyl tris (trimethylsiloxy and 70% by weight or less of a petroleum-based hydrocarbon solvent.

9. A method of dry cleaning of a fabric material as claimed in claim 1, wherein said petroleum-based hydrocarbon solvent is paraffinic.

10. A method of dry cleaning of a fabric material as claimed in claim 1, wherein said petroleum-based hydrocarbon solvent is naphthenic.

11. A dry cleaning solvent according to claim 4, wherein said petroleum-based hydrocarbon solvent is paraffinic.

12. A dry cleaning solvent according to claim 4, wherein said petroleum-based hydrocarbon solvent is naphthenic.

* * * * *